US009617735B2

(12) United States Patent
Jozwiak et al.

(10) Patent No.: US 9,617,735 B2
(45) Date of Patent: Apr. 11, 2017

(54) SECONDARY HANDRAIL FOR STAIRS

(71) Applicants: Matthew Jozwiak, Alden, NY (US); Marc Egleston, Elma, NY (US)

(72) Inventors: Matthew Jozwiak, Alden, NY (US); Marc Egleston, Elma, NY (US)

( * ) Notice: Subject to any disclaimer, the term of this patent is extended or adjusted under 35 U.S.C. 154(b) by 127 days.

(21) Appl. No.: 14/326,700

(22) Filed: Jul. 9, 2014

(65) Prior Publication Data

US 2016/0010340 A1 Jan. 14, 2016

(51) Int. Cl.
*E04H 17/00* (2006.01)
*E04F 11/18* (2006.01)

(52) U.S. Cl.
CPC ..... *E04F 11/1804* (2013.01); *E04F 11/1808* (2013.01)

(58) Field of Classification Search
CPC ..... E04F 11/81; E04F 11/1804; E04F 11/181; E04F 11/1812; E04F 11/1842; E04H 17/1413
USPC .. 256/59, 65.01, 65.02, 65.04, 65.05, 65.08, 256/65.15, 68
See application file for complete search history.

(56) References Cited

U.S. PATENT DOCUMENTS 1,772,159 A * 8/1930 Roth ..... E04F 11/1834 256/65.08
3,007,678 A 11/1961 Buehler
3,026,080 A 3/1962 Thurnauer
3,161,425 A 12/1964 Aho et al.
4,948,100 A * 8/1990 Stevens ..... E04F 11/1863 248/220.1
5,551,194 A 9/1996 Toomey
6,021,984 A * 2/2000 Mills ..... F16M 11/14 248/219.4
7,540,472 B2 * 6/2009 Striebel ..... E04F 11/1812 256/65.07
8,356,802 B2 1/2013 Reich
2006/0118773 A1 * 6/2006 Hull ..... E04F 11/1804 256/59
2008/0191185 A1 * 8/2008 Barnes ..... E04F 11/1834 256/67
2010/0252792 A1 10/2010 Bennett
2011/0089390 A1 * 4/2011 Steinkraus ..... E04F 11/181 256/65.02

(Continued)

*Primary Examiner* — Daniel P Stodola
*Assistant Examiner* — Nahid Amiri
(74) *Attorney, Agent, or Firm* — The Keys Law Firm PLLC

(57) ABSTRACT

A secondary handrail for mounting below a conventional handrail to enable smaller individuals, such as children, to use it while ascending or descending stairs. The secondary handrail includes a mounting bracket defined by a rigid bracket body, a rail attachment member, a plurality of fastener docks, and a spindle depression as well as a rail member, and extension sleeves. In operation, a plurality of mounting brackets are mounted sequentially under a conventional handrail through an attachment to the wall or a spindle, with a plurality rail members extending between each mounting bracket. In this regard, the mounting bracket provides for the mounting of the secondary handrail below the conventional staircase and fastening the secondary handrail to a wall or spindle and the rail member provides a mounted rail for assisting an individual in ascending or descending the stairs.

6 Claims, 4 Drawing Sheets

(56) References Cited

U.S. PATENT DOCUMENTS

| | | | | |
|---|---|---|---|---|
| 2011/0133146 | A1* | 6/2011 | Mao-Cheia | E04F 11/1817 256/68 |
| 2012/0032130 | A1* | 2/2012 | Graber | E04F 11/1836 256/65.02 |
| 2014/0097394 | A1* | 4/2014 | Hsieh | E04F 11/1804 256/65.15 |

* cited by examiner

SECONDARY HANDRAIL FOR STAIRS

BACKGROUND OF THE INVENTION

Field of the Invention

This invention relates generally to mounted handrails and, more particularly, to a secondary handrail for stairs intended to be mounted below existing handrails.

Description of the Prior Art

The construction and use of handrails disposed next to stairs for use in assisting individuals ascend or descend stairs is a well known. A problem which still exists, however, is that conventional handrails are typically mounted at a height that contemplates comfortable use by adults. Consequently, children are commonly unable to reach or comfortably grasp the conventional handrail. Thus, there remains a need for a secondary handrail which would be disposed at a height which made it easier for children to grasp while ascending or descending stairs. It would be helpful if such a secondary handrail included a bracket which attached it to a wall to ensure adequate stability. It would be additionally desirable for such a secondary handrail to be structured to attach to either an existing wall or spindle.

The Applicant's invention described herein provides for a secondary handrail adapted to allow shorter individuals, particularly children, to grasp for stability and support while ascending or descending stairs. The primary components in Applicant's secondary handrail are a mounting bracket and a plurality of rail members. When in operation, the secondary handrail enables a supplemental handrail to be secured adjacent to a stairwell at a height which makes it accessible to children. As a result, many of the limitations imposed by prior art structures are removed.

SUMMARY OF THE INVENTION

A secondary handrail for mounting below a conventional handrail to enable smaller individuals, such as children to use it while ascending or descending stairs. The secondary handrail comprises a mounting bracket defined by a rigid bracket body, a rail attachment member, a plurality of fastener docks, and a plurality of recesses as well as discrete rail member, and extension sleeves. In operation, a plurality of mounting brackets are mounted sequentially under a conventional handrail by through an attachment to the wall or a spindle, with a plurality rail members extending between each mounting bracket. In this regard, the mounting bracket provides a means for mounting the secondary handrail below the conventional staircase and fastening the secondary handrail to a wall and the rail member provides a rail means for attaching to the mounting means and assisting an individual in ascending or descending the stairs.

It is an object of this invention to provide a secondary handrail which would be disposed at a height which made it easier for children to grasp while ascending or descending stairs.

It is another object of this invention to provide a secondary handrail which includes a bracket which attached it to a wall to ensure adequate stability.

It is yet another object of this invention to provide a secondary handrail attachable to either an existing wall or spindle.

These and other objects will be apparent to one of skill in the art.

DETAILED DESCRIPTION OF THE INVENTION

Figure 1:
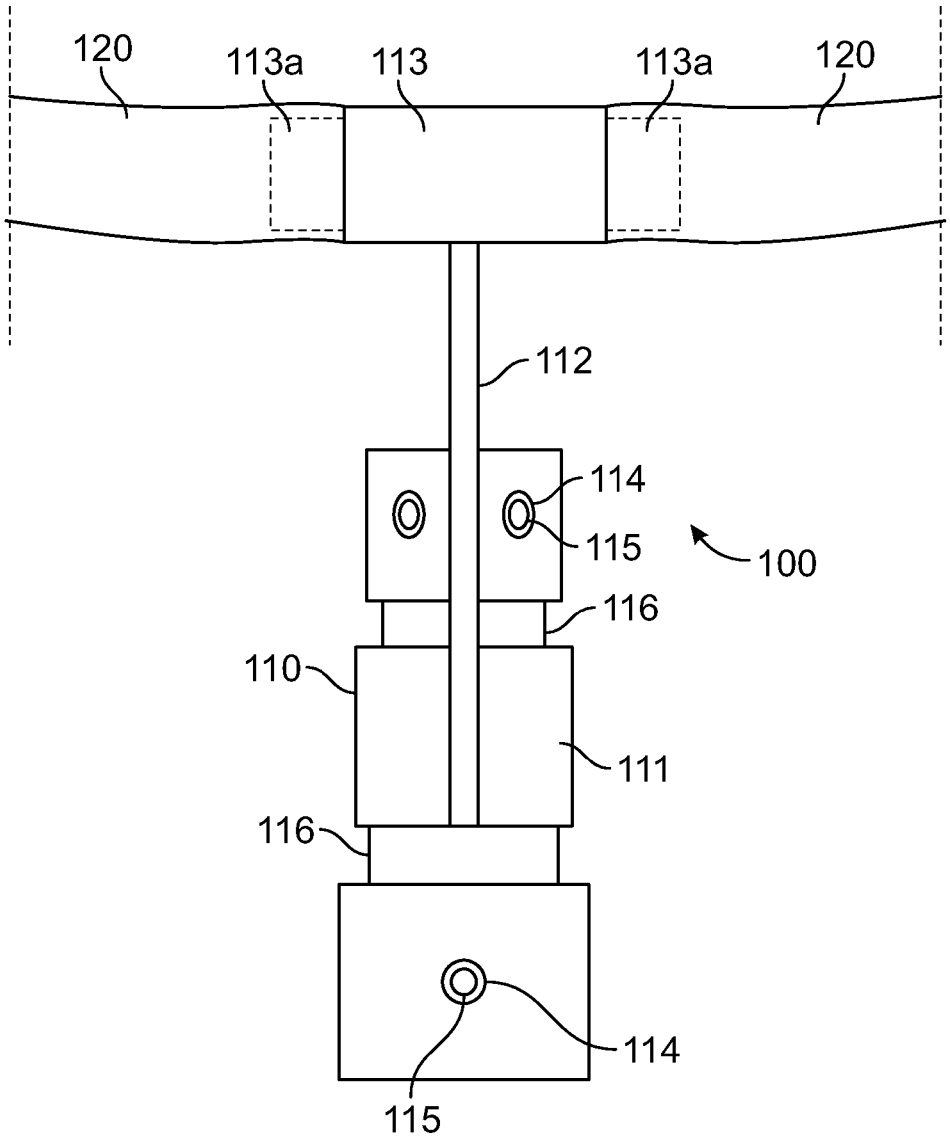
FIG. 1 is a side elevational view of a secondary handrail built in accordance with the present invention.
Figure 2:
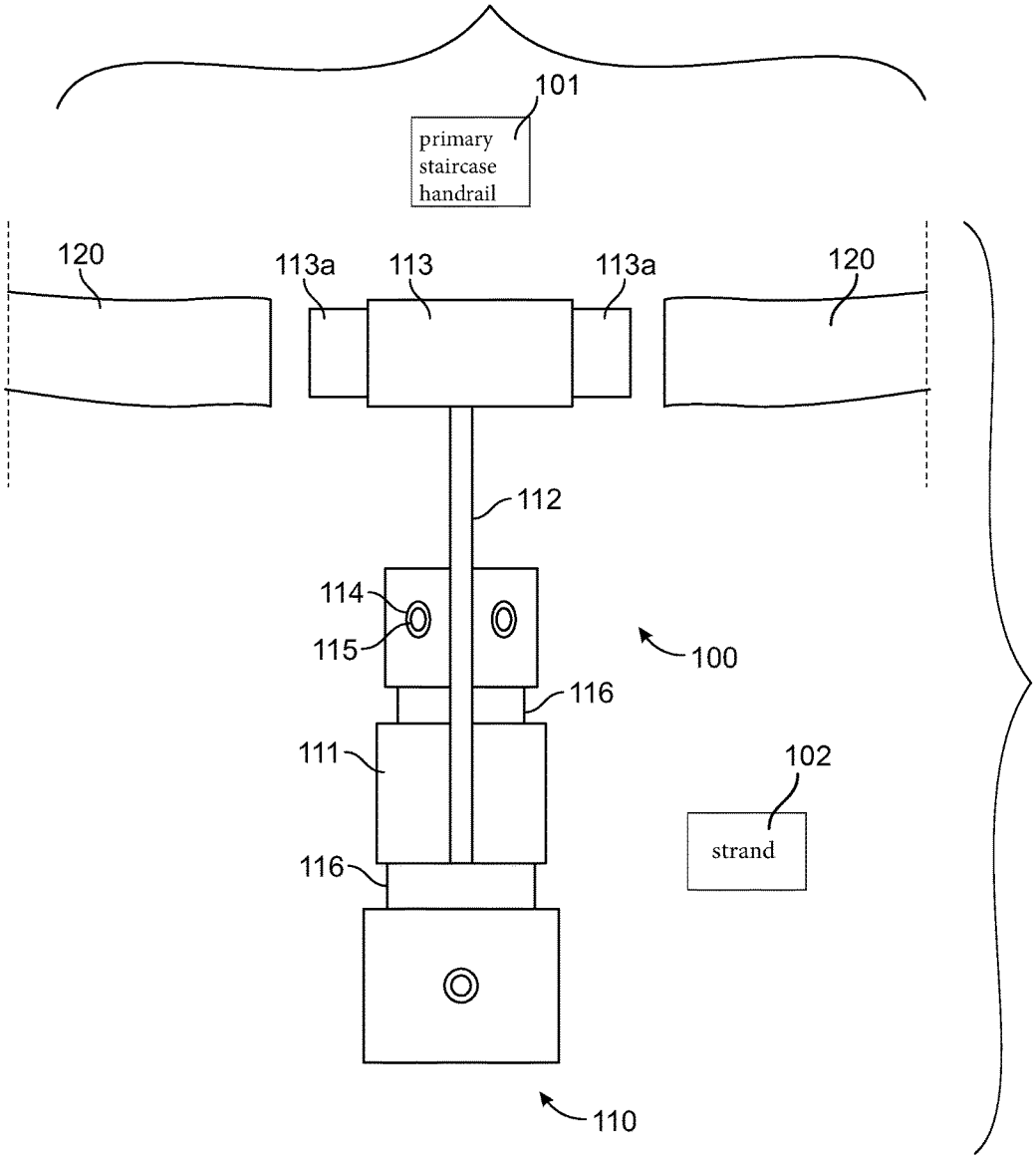
FIG. 2 is a side elevational view of a handrail assembly with a secondary handrail for mounting below a primary staircase handrail built in accordance with the present invention.
Figure 3:
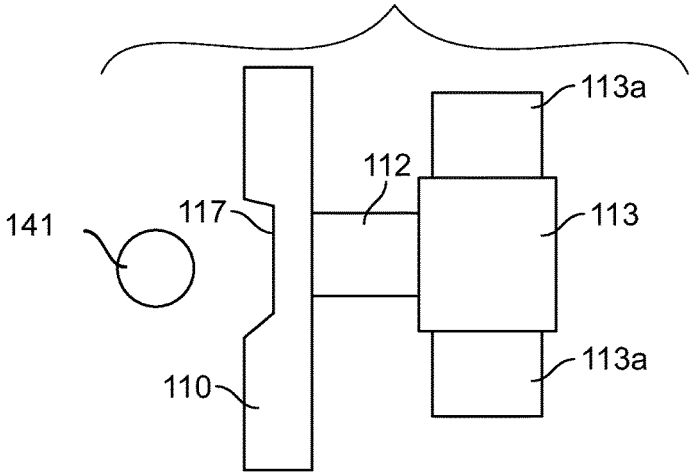
FIG. 3 is a top plan view of the mounting bracket of a secondary handrail built in accordance with the present invention.
Figure 4:
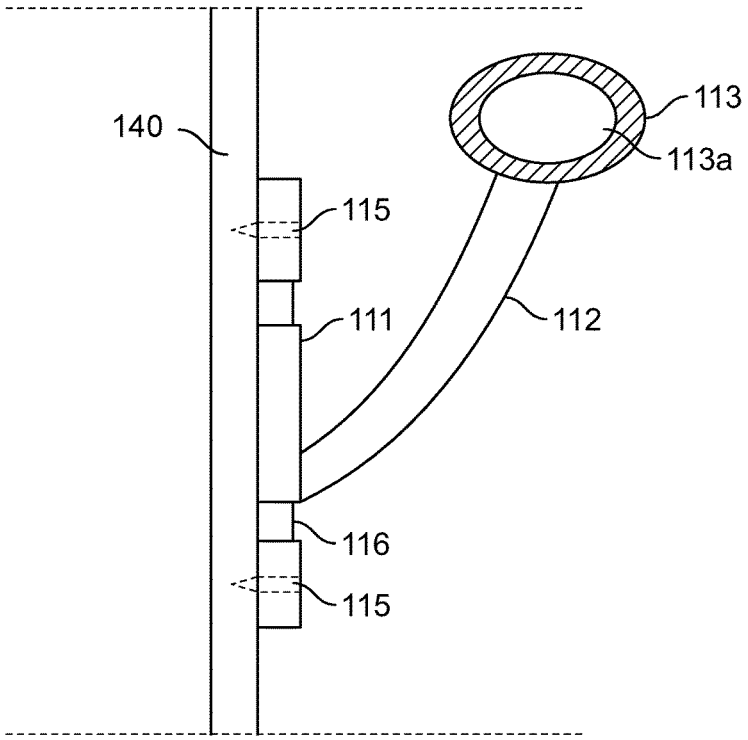
FIG. 4 is a front elevational view of the mounting bracket of a secondary handrail built in accordance with the present invention.

Referring now to the drawings and in particular FIGS. 1, 2, 3 and 4, a handrail assembly in accordance with the present invention includes a secondary handrail 100 mountable below a primary staircase handrail 101. The primary staircase handrail 101 defines a conventional staircase handrail. The secondary handrail 100 is shown having a mounting bracket 110 and discrete rail members 120. The mounting bracket 110 is defined by a rigid bracket body 111, a rail arm 112, a rail attachment member 113 and a plurality of fastener docks 114. In the preferred embodiment, bracket body 111 is 3 5/16 inches long and each fastener 114 is defined as a screw.

The bracket body 111 is configured to be fastened to a wall 140 or other flat surface through the fastener docks 114, which are each defined by apertures in the bracket body 111 that enable a fastener 115 to pass through the bracket body into the wall 140, anchoring the bracket body 111 to the wall 140.

The bracket body 111 additionally includes two body recesses 116 and a back recess 117 to enable it the be attached to a conventional spindle 141. In this regard, the bracket body 111 can be placed against the spindle 141 with the spindle 141 surface engaging the back recess 117 and a conventional strand 102, such as a rope, can be tied around the spindle 141 and bracket body 111, contacting the body recess 116 and the spindle 141 and encircling the two. It is contemplated that two strands can be used, with one encircle the bracket body 111 and spindle 141 in this manner in each of the body recesses 116.

Extending upwards from the bracket body 111 is the rail arm 112. At the end of the rail arm 112 is a rail attachment member 113, which includes two fastening nubs **113*a* extending longitudinally therefrom. The fastening nubs 113*a* enable the rail attachment member 113 to receive discrete rail members 120 for use in accordance with the secondary handrail 100**, in the manner discussed in greater detail below.

Each discrete rail member 120 is defined as an elongated, hollow tube which in the preferred embodiment, is 4 to 5 feet long and defined by a conventional PVC pipe. The rail members 120 are sized to slide over the fastening nub **113*a*, sleeving thereon to be held in place thereby. It is contemplated that rail members 120 would be mounted in accordance with the present invention to sleeve onto the fastening nub 113*a* on the first side of a first mounting bracket 110 and to sleeve onto the fastening nub 113*a*** on the opposing, second side of a second mounting bracket mounting sequentially in the staircase from the first.

Figure 5:
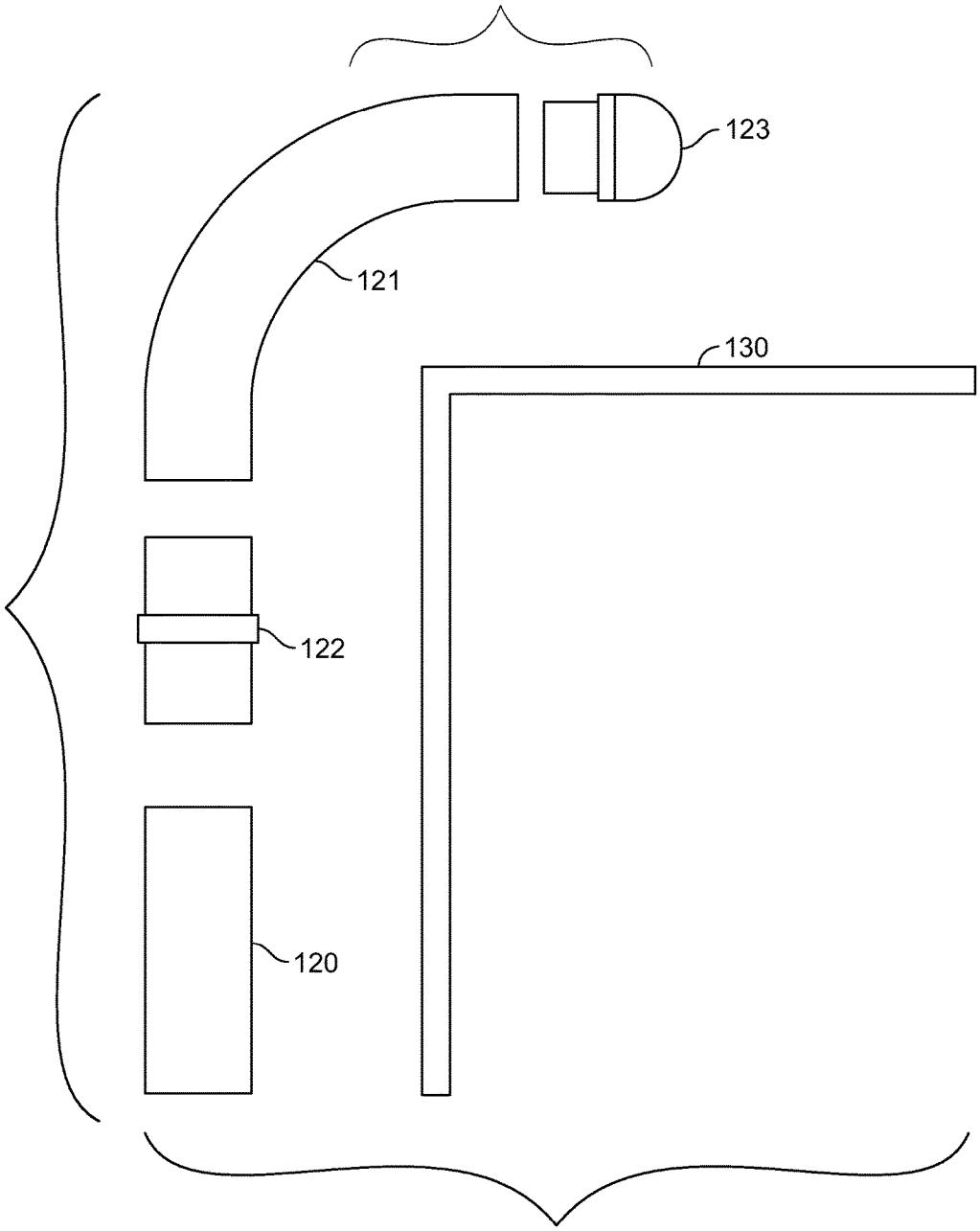
FIG. 5 an exploded top plan view of the extension sleeve and end cap of a secondary handrail built in accordance with the present invention

Referring now to FIG. 5, curved pipe members 121 are employed when it is required for the secondary handrail to extend around a corner 130. In such scenarios, or in scenarios wherein the rail members 120 are not able to extend from one mounting bracket to the next sequential mounting bracket, extension sleeves 122, shaped to enable rail members to sleeve on either end, are employed. It is additionally contemplated that end caps 123 which are shaped to only sleeve on a rail member 120 on one end can be attached to the end of the last rail member 120 (or other pipe member 121) the top or bottom of a staircase.

It is understood that while a 90 degree curve pipe is illustrated as the curved pipe member 121, any type of curve may be employed to meet the dimensions of the staircase or the orientation of sequential mounting brackets.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A handrail assembly having a secondary handrail for mounting below a primary staircase handrail, comprising:

a secondary handrail having a mounting bracket and a plurality of hollow rail members, wherein the mounting bracket includes a bracket body, a rail arm extending from the bracket body and a rail attachment member integral with the rail arm and having a first end and a second end;

wherein said mounting bracket is configured to be fastened to either a wall or a spindle;

wherein the plurality of hollow rail members are each configured to attach to and extend from at least one of the first end and the second end;

wherein the first end and the second end are adapted to be oriented relative to the primary staircase handrail under which the mounting bracket is mounted such that each of the rail members, when extending from the first end or second end, extend parallel to the primary staircase handrail;

wherein said bracket body includes at least one longitudinally oriented body recess adapted to receive a strand which encircles the bracket body and the spindle together when the bracket body is placed against the spindle, thereby configuring the mounting bracket to be fastened to the spindle; and wherein said bracket body additionally includes a back recess oriented orthogonally relative to the at least one body recess and in which the spindle is received when the bracket body is placed against the spindle.

2. The handrail assembly of claim 1, wherein said first end and said second end are each defined by a fastening nub sized to enable said rail members to sleeve thereon.

3. The handrail assembly of claim 1, wherein said bracket body includes at least one fastener dock adapted to receive a fastener that couples said bracket body with the wall, thereby configuring the mounting bracket to be attached to the wall with the fastener.

4. The handrail assembly of claim 3, wherein said at least one fastener dock defines an aperture in the bracket body which enables the fastener to engage the bracket body and the wall.

5. The handrail assembly of claim 4, wherein said fastener is defined by a screw.

6. The handrail assembly of claim 1, wherein the first end and the second end are mirror images of one another and each rail member is configured to attach to and extend from either the first end and the second end.

* * * * *